US007046142B2

(12) United States Patent
Hershkovitz et al.

(10) Patent No.: US 7,046,142 B2
(45) Date of Patent: May 16, 2006

(54) SECURITY SYSTEM USER INTERFACE

(75) Inventors: Shmuel Hershkovitz, Freeport (BS); Stéphane Lauzon, St-Eustache (CA); Christian Ouellet, Terrebonne (CA)

(73) Assignee: Paradox Security Systems Ltd., St-Eustache (CA)

( * ) Notice: Subject to any disclaimer, the term of this patent is extended or adjusted under 35 U.S.C. 154(b) by 51 days.

(21) Appl. No.: 10/378,656

(22) Filed: Mar. 5, 2003

(65) Prior Publication Data

US 2004/0174256 A1 Sep. 9, 2004

(51) Int. Cl.
*G08B 13/00* (2006.01)

(52) U.S. Cl. ..... 340/541; 340/506; 340/524; 340/525; 340/825.36; 340/825.49

(58) Field of Classification Search ..... 340/506, 340/520, 525, 254, 825.36, 825.49, 541, 340/524

See application file for complete search history.

(56) References Cited

U.S. PATENT DOCUMENTS 5,086,385 A * 2/1992 Launey et al. ..... 700/83
5,258,837 A 11/1993 Gormley
D346,755 S 5/1994 Soloway
D357,638 S 4/1995 Hetherington
5,519,878 A * 5/1996 Dolin, Jr. ..... 709/220
5,907,288 A * 5/1999 Clark et al. ..... 340/5.54
6,281,790 B1 * 8/2001 Kimmel et al. ..... 340/506
2003/0234731 A1 * 12/2003 Rhodes et al. ..... 340/870.09
2004/0049577 A1 * 3/2004 Imhof ..... 709/224
2004/0051739 A1 * 3/2004 Schmickley et al. ..... 345/772

OTHER PUBLICATIONS

ADEMCO, Group Release Symphony, Revolutionary Touchscreen Interface Orchestrates Security and Home Control, Syosset, NY Aug. 14, 2002.

* cited by examiner

*Primary Examiner*—Julie Bichngoc Lieu
(74) *Attorney, Agent, or Firm*—Ogilvy Renault LLP

(57) ABSTRACT

A security system user interface comprising a graphical display, a communication link, a memory, and a display controller. The communication link receives detector unit status data from detector units located at selected location on the premises protected by the security system. The memory stores floor plan diagram data and detector unit location data. Finally, the display controller generates a modified view of at least a portion of the floor plan diagram data in accordance with the detector unit status data to indicate the status data, and displaying the modified view on the graphical display. The invention also provides, in combination, a user interface and a user programming interface for transmitting the floor plan diagram data and the detector unit location data to the communications interface of the user interface.

26 Claims, 4 Drawing Sheets

SECURITY SYSTEM USER INTERFACE

FIELD OF THE INVENTION

The present invention relates to the field of method and devices for interfacing with security systems assuring protection of buildings or other types of premises or locations.

BACKGROUND OF THE INVENTION

Examples of prior art devices are shown in U.S. Pat. No. 5,258,8377 dated Nov. 2, 1993, D346,755, dated May 10, 1994, D357,638, dated Apr. 25, 1995 and the "Symphony" family of display products by ADEMCO (see www.ademco.com/press_releases/2002/pr081402f.htm). These documents show interfaces for a user to interact with a security system protecting a premise. The interface is used to enter, for example, arm/disarm codes, give information about individuals who have accessed the premise, give an indication of trouble areas, etc.

Security systems normally also include a central control panel or base unit and detectors installed in selected areas of the premise. The detectors include, for example, movement detectors and contact detectors. Generally, when one of the detectors is triggered (i.e., trouble is present), a signal is generated to produce an audible, visual or vibrating alarm. The premise's user interface may also receive a signal indicating in which area or zone the trouble is present. Each area or zone may be protected by one or more detector. Hence, in an area, a door and a window can be protected by contact detector and the space of the area can be protected by a movement detector.

One of the drawbacks with prior art devices is that they are not very user-friendly. For example, it may be difficult to enter information into them, to readily identify which protected zone is affected by trouble, and personalize the display for each user. Thus, there is a need in the industry for improved security system interfaces.

SUMMARY OF THE INVENTION

It is an object of the invention to provide a security system user interface that is easier to use and which has more functionality and better capability than prior art devices.

In a preferred embodiment, the present invention provides a user interface for a security system. The user interface comprises a graphical display, a communication link, a memory, and a display controller. The communication link receives detector unit status data from detector units located at selected location on the premises protected by the security system. The memory stores floor plan diagram data and detector unit location data. Finally, the display controller generates a modified view of at least a portion of the floor plan diagram data in accordance with the detector unit status data to indicate the status data, and displaying the modified view on the graphical display.

In another embodiment of the invention, the invention provides a method of interfacing with a graphical display of a security system having detector units. The method comprises receiving detector unit status data over a security control detector unit communication link; storing floor plan diagram data and detector unit location data in a memory; generating a modified view of at least a portion of the floor plan diagram data in accordance with the detector unit status data to indicate said status data; and displaying the view on the display.

In another embodiment, the invention provides in combination, a user interface and a user programming interface. The user interface comprises a graphical display as described above having, in addition, a communications interface for communicating said floor plan diagram data and detector unit location data to said memory. The user programming interface comprises a floor plan drawing module and an upload module. The floor plan drawing module is adapted to specify the floor plan diagram data and the detector unit location data. The drawing module displays a view of the floor plan with detector units in location. The upload module for transmits the floor plan diagram data and the detector unit location data to the communications interface.

In yet another of the invention, a method for modifying a user interface for a security system. The method comprises inputting information to a drawing module to produce a floor plan diagram and detector unit location data. The drawing module displays a view of said floor plan with detector units in location. Finally, the method comprises transmitting the floor plan diagram data and the detector unit location data to the user interface.

DETAILED DESCRIPTION OF THE INVENTION

Figure 1:
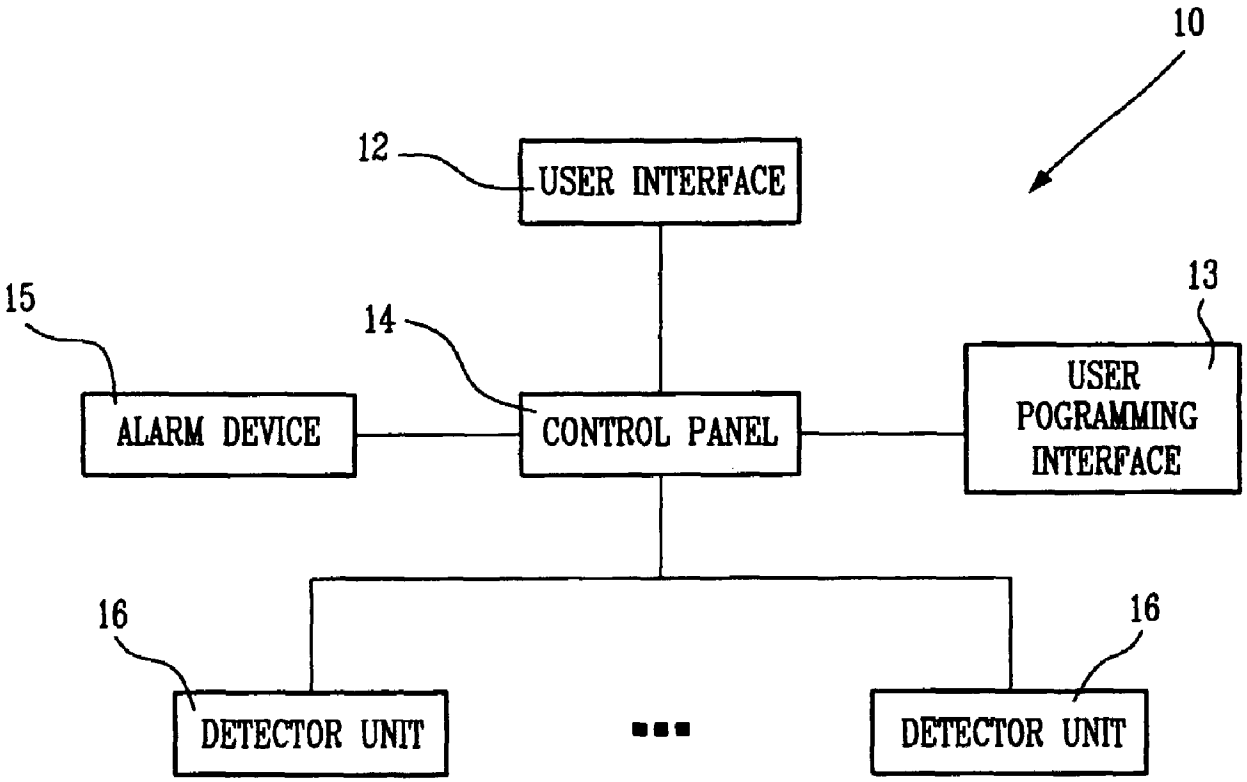
FIG. 1 is a block diagram showing a security system protecting a premise.

Referring to FIG. 1, a security system 10 protecting a location is shown. The location (not shown) could be, but is not limited to, for example, a building, a home, means of transportation, exterior grounds, etc. Security system 10 includes a user interface 12, a control panel 14, a user programming interface 13, one or more alarm devices 15, and detector units 16 installed in selected areas of the premise being protected. In other embodiments of the invention, the security system 10 may be connected to other devices, such as home lights, garage door, etc., or networks, such as a local network, cellular networks, land line telephone networks, or the Internet.

User interface 12 and control panel 14 are connected. Detector units 16 are connected to control panel 14. One or more alarm devices 15 are connected to control panel 14. Finally, a user programming interface may also be connected to control panel 14. Communication links between security system 10 entities could be electrical, optical, infra-red or any other types of links which enable communication between the security system 10 entities. A person skilled in the art will understand that the security system 10 entities may also be interconnected in other configurations as would be the case if a bus was used instead of individual connection between each entity of the security system 10. Embodiments (not shown in FIG. 1) where detector units 16, user programming interface 13, and/or alarm devices 15 have direct communication links to the user interface are also contemplated. Such embodiments would include, for example, coaxial cable link for sending a video image of a visitor requesting entrance to the premises could be displayed on user interface 12. Embodiments where some or all detector units 16 are connected in series are also contemplated.

Detector units 16 may include, for example, movement detectors, contact detectors, weight detectors, surveillance cameras or any other type of detectors considered useful by a person skilled in the art of security systems. In an embodiment of the invention, when one of the detector units 16 is triggered (i.e., trouble is present) and the security system 10 is armed, a signal is generated and sent over link 19 to control panel 14. Control panel 14 sends a signal to an alarm device 15 to produce an audible, visual or vibrating alarm. It is also possible to send an alarm signal over a network to communicate to the user, by phone, email, or other means, that the alarm has been triggered. In an embodiment, user interface 12 receives a signal indicating in which area or zone the trouble is present. Each area or zone may be protected by one or more detector units 16. Hence, in an area, a door and a window can be protected by contact detector and the space of the area can be protected by a movement detector.

Figure 2:
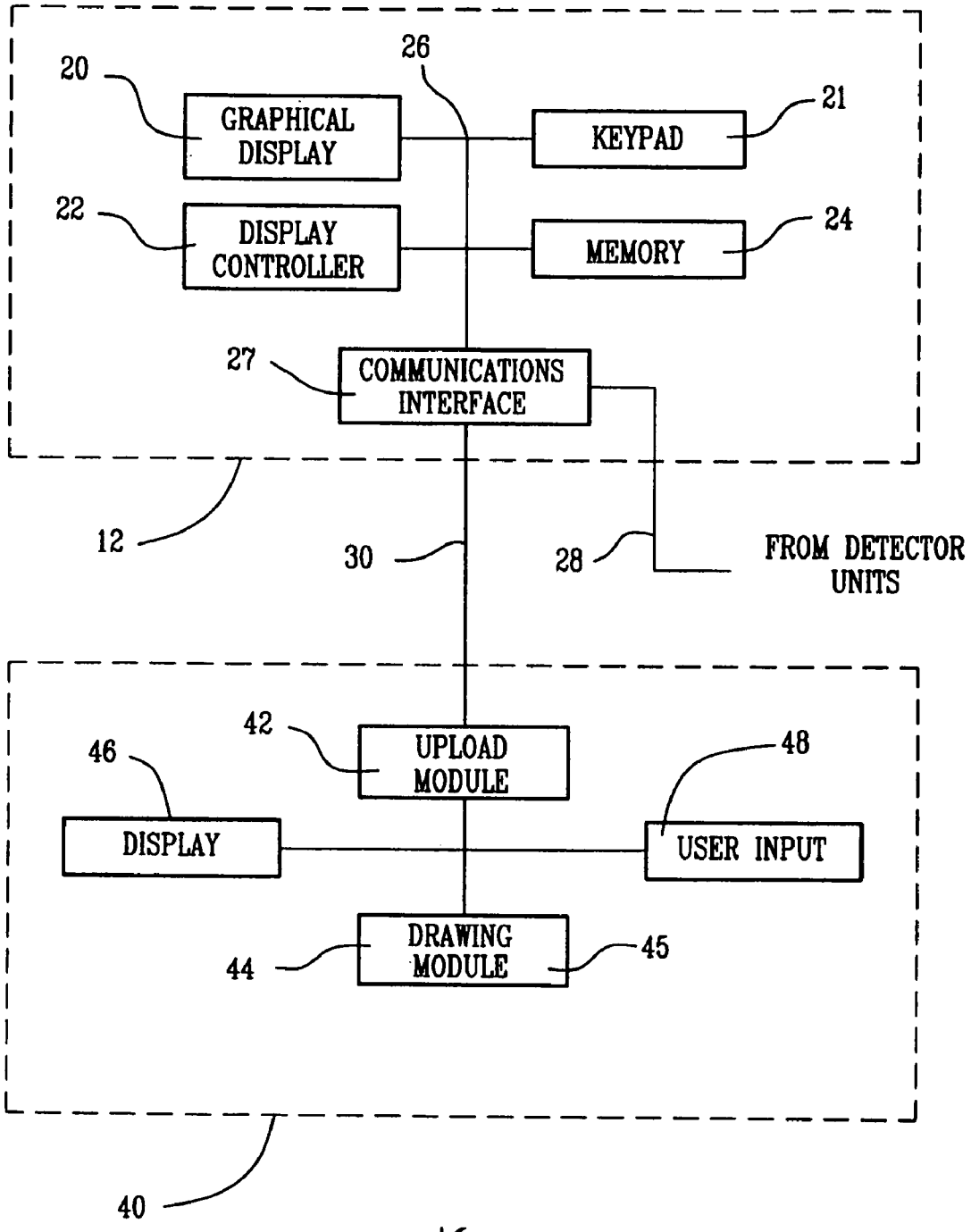
FIG. 2 is a block diagram showing a security system user interface and a user programming interface in accordance with an embodiment of the invention.

Now referring to FIG. 2, a security system user interface 12 connected to a user programming interface 40 via a communication link 30 is shown. User interface 12 may be used to enter, for example, arm/disarm codes, give information about individuals who have accessed the premise, give an indication of trouble areas, show reminders for special events, display information from the Internet, display images, etc.

User interface 12 comprises a graphical display 20, a keypad 21, a display controller 22, a memory 24, and a communication interface 27. The entities of user interface 12 are interconnected via bus 26. Other means of interconnecting said entities know to those skilled in the art are considered part of other embodiments of the invention. A security control detector unit communication link 28 is also connected to user interface 12 for receiving detector unit 16 status data. It is conceivable that memory 24 and display controller 22 be external the user interface 12. Details regarding graphical display 20 and keypad 21 are given hereinbelow with the description of FIGS. 3 and 4.

Memory 24 is used to store floor plan diagram data and detector unit location data. Memory 24 may also record events from detectors 16. The recorded events could be as simple as the triggering of a detector or as complex as video images.

Figure 3:
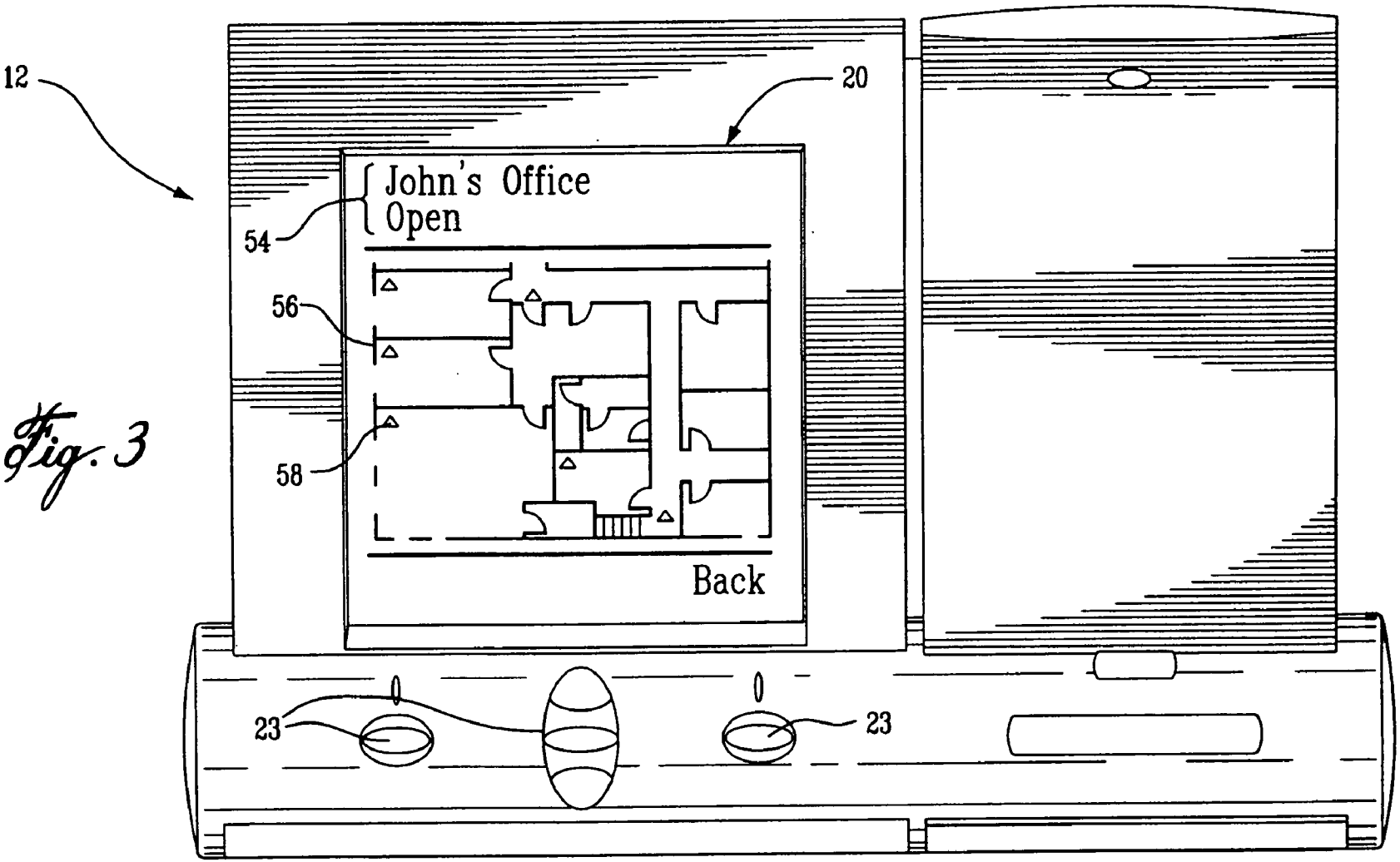
FIGS. 3 and 4 are top plan views of a security system interface in accordance with an embodiment of the invention.

The user programming interface 40 comprises an upload module 42, a drawing module 44 and a programming module display 46 interconnected by a bus 45. The drawing module 44 accepts user input 48. The user specifies a floor plan diagram as well as detector unit location data (as shown in FIG. 3). The drawing module 44 enables the display of the floor plan diagram with detector units in location via a programming module display 46. The upload module 42 transmits the floor plan diagram data and the detector unit location data to the communication interface 27. Communications interface 27 communicates floor plan diagram data and detector unit location data to memory 24.

Communications interface 27 may also restricts access to user interface 12 so as to allow only memory 24 to be updated. Display controller 22 displays a text-based message providing status data when a condition is to be reported concerning one of detector units 16 and one of detector units 16 is not defined by detector unit location data in memory 24.

FIG. 3 shows security system interface 12 in accordance with a particular embodiment of the invention. User interface 12 is in a mode where a floor plan diagram 56 is shown on graphical display 20. Divisions are shown along with icons 58 (e.g., triangles) indicating location of detector units 16. Various icons 58 could be used to represent the different type of detectors 16. A text-based message 54 corresponding to the status of a particular detector 16 ("Open") in a specified area ("John's Office") is also present on graphical display 20. In a particular embodiment of the invention, a user navigates through zones and/or detectors and other menus using keys 23.

User interface 12 may receive detector unit status data from a number of detector units 16 each covering a protected zone. When status data indicate a condition to be reported in one of the protected zones, a modified view of the floor plan diagram 56 includes the foregoing protected zones It is also envisaged that display controller 22 will automatically switch from a stand-by display to the foregoing modified view in response to an indication of a condition to be reported. The foregoing condition may be one of a trouble condition and an alarm condition. The foregoing modified view may show one of the protected zones by at least one of flashing, color change and symbol change. The modified view may show either one of a protected zones and a text representation of status data of a detector unit 16.

The user interface 12 may be configured such that when status data indicate a condition to be reported in two or more protected zones and the two or more protected zones cannot be shown on said display efficiently in a single view, the display controller 22 alternates between a plurality of views indicating status data for the two or more protected zones.

Figure 4:
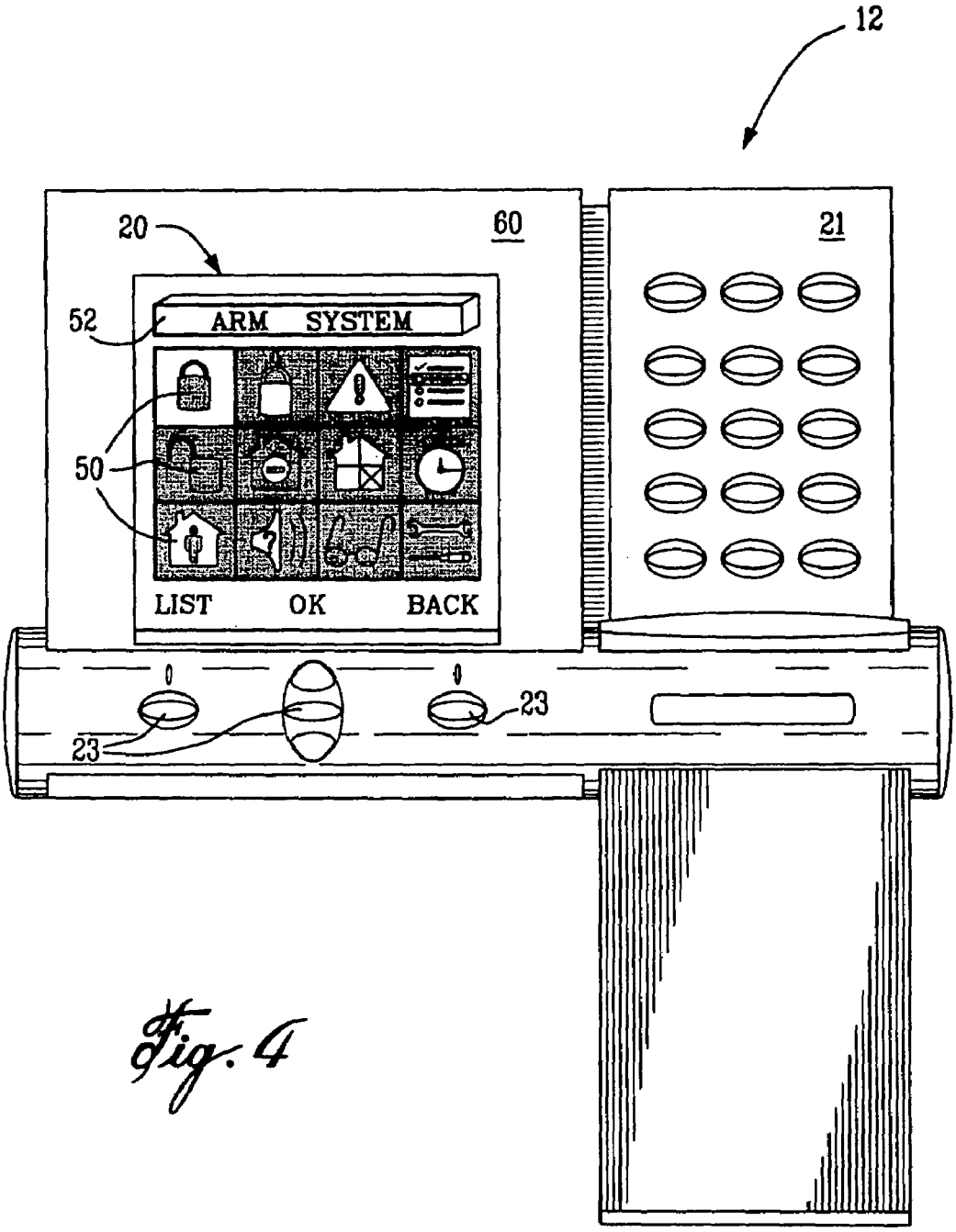

FIG. 4 shows security system interface 12 in accordance with a particular embodiment of the invention. User interface 12 is in a mode where icons 50 for controlling the security system 10 are shown on graphical display 20. A text-based message 52 corresponding to the selected icon 50 is also present on graphical display 20. In a particular embodiment of the invention, icons 50 and other menus are selected using keys 23.

FIG. 4 also shows a housing 60 for holding keypad 21 and graphical display 20 in a single unit. In an embodiment of the invention, graphical display 20 comprises a touch screen, and keypad 21 is provided using the touch screen. Graphical display 20 may comprise a liquid crystal display. In an embodiment of the invention, the physical arrangement of the keypad 21 adjacent the graphical display 20 in the housing 60 is detailed in the applicant's U.S. design application Ser. No. 29/177,157 filed on the same date as the present utility application, the specification of which is hereby incorporated by reference.

Display controller 22 may be configured to display a text-based message (not shown) providing status data when a condition is to be reported concerning one of the detector units and wherein the foregoing detector unit is not defined by detector unit location data in memory 24.

User interface 12 may also comprise a time clock (not shown) and a message manager unit (not shown) storing special graphics message data and related display time data. The message manager unit will cause graphical display 20 to display the special graphics message data according to the display time data. User interface 12 may also comprise a sound generator (not shown). The foregoing special graphics message data include music data to be played by the message manager unit.

Although some preferred implementations of various methods and arrangements have been illustrated in the accompanying drawings and described in the foregoing description, it will be understood that the invention is not limited to the exemplary implementations disclosed, but is capable of numerous rearrangements, modifications and substitutions as set forth and defined by the following claims.

The invention claimed is:

1. A wall mountable user interface for a security system comprising:

a. a graphical display;

b. a security control detector unit communication interface for receiving detector unit status data;

c. a memory for storing floor plan diagram data and detector unit location data, said memory comprised within said user interface;

d. a display controller for generating a modified view of at least a portion of said floor plan diagram data in accordance with said detector unit status data to indicate said status data, and displaying said view on said display;

e. a data entry keypad for permitting user interaction with said user interface; and f. a housing for holding said display and said keypad as a single unit.

2. The user interface of claim 1, wherein said display comprises a liquid crystal display.

3. The user interface of claim 1, wherein said user interface receives said detector unit status data from a number of detector units each covering a protected zone, and when said status data indicates a condition to be reported in one of said protected zones, said view includes said one of said protected zones.

4. The user interface of claim 3, wherein said display controller automatically switches from a stand-by display to said view in response to indication of said condition.

5. The user interface of claim 4, wherein said condition is one of a trouble condition and an alarm condition.

6. The user interface of claim 3, wherein said view shows said one of said protected zones by at least one of flashing, color change and symbol change.

7. The user interface of claim 3, wherein said view shows said one of said protected zones and a text representation of said status data.

8. The user interface of claim 3, wherein when said status data indicates a condition to be reported in two or more of said protected zones and said two or more of said protected zones cannot be shown on said display efficiently in a single view, said controller alternates between a plurality of said views indicating said status data for said two or more of said protected zones.

9. The user interface of claim 1, wherein said display comprises a touch screen, and said keypad is provided using said touch screen.

10. The user interface of claim 1, further comprising a communications interface for communicating said floor plan diagram data and detector unit location data to said memory.

11. The user interface of claim 10, wherein said communications interface restricts access to said user interface so as to allow only said memory to be updated, said display controller displaying a text-based message providing said status data when a condition is to be reported concerning one of said detector units and said one of said detector units is not defined by said detector unit location data in said memory.

12. The user interface of claim 1, wherein said display controller displays a text-based message providing said status data when a condition is to be reported concerning one of said detector units and said one of said detector units is not defined by said detector unit location data in said memory.

13. The user interface of claim 1, wherein said user interface comprises a time clock, said user interface further comprising a message manager unit storing special graphics message data and related display time data, and causing said display to display said special graphics message data according to said display time data.

14. The user interface of claim 13, wherein said user interface comprises a sound generator, said special graphics message data include music data to be played by said message manager unit.

15. In combination, a wall mountable user interface and a user programming interface, a. said user interface comprising:

i. a graphical display;

ii. a security control detector unit communication interface for receiving detector unit status data;

iii. a memory for storing floor plan diagram data and detector unit location data, said memory comprised within said user interface;

iv. a display controller for generating a modified view of at least a portion of said floor plan diagram data in accordance with said detector unit status data to indicate said status data, and displaying said view on said display;

v. a communications interface for communicating said floor plan diagram data and detector unit location data to said memory;

vi. a data entry keypad for permitting user interaction with said user interface; and vii. a housing for holding said display and said keypad as a single unit.

b. said user programming interface comprising:

i. a floor plan drawing module adapted to specify said floor plan diagram data and said detector unit location data, said drawing module displaying a view of said floor plan with detector units in location; and ii. an upload module for transmitting said floor plan diagram data and said detector unit location data to said communications interface.

16. A method of interfacing with a wall mountable user interface of a security system having detector units, said method comprising:

a. producing, displaying and storing a floor plan diagram and detector unit location data, wherein said storing occurs in a memory comprised within said user interface;

b. generating a modified view of at least a portion of said floor plan diagram data in accordance with said detector unit status data to indicate said status data; and c. displaying said modified view;

wherein said user interface automatically switches from a stand-by display to said view in response to indication of said condition.

17. The method of claim 16, further comprising permitting user interaction with said user interface using a data entry keypad.

18. The method of claim 16, wherein said user interface receives said detector unit status data from a number of detector units each covering a protected zone, and when said status data indicates a condition to be reported in one of said protected zones, said view includes said one of said protected zones.

19. The method of claim 18, wherein said condition is one of a trouble condition and an alarm condition.

20. The method of claim 18, wherein said view shows said one of said protected zones by at least one of flashing, color change and symbol change.

21. The method of claim 18, wherein said view shows said one of said protected zones and a text representation of said status data.

22. The method of claim 18, wherein when said status data indicates a condition to be reported in two or more of said protected zones and said two or more of said protected zones cannot be shown on said display efficiently in a single view, said method further comprising alternating between a plurality of said views indicating said status data for said two or more of said protected zones.

23. The method of claim 22, wherein said communications interface restricts access to said user interface so as to allow only said memory to be updated, said method further comprising displaying a text-based message providing said status data when a condition is to be reported concerning one of said detector units and said one of said detector units is not defined by said detector unit location data in said memory.

24. The method of claim 16, further comprising displaying a text-based message providing said status data when a condition is to be reported concerning one of said detector units and said one of said detector units is not defined by said detector unit location data in said memory.

25. The method of claim 16, further comprising storing special graphics message data and related display time data, and causing said display to display said special graphics message data according to said display time data.

26. The method of claim 25, wherein said special graphics message data comprises music data and wherein said method further comprises generating a sound using said music data.

* * * * *